United States Patent [19]

Weissenfluh

[11] 4,362,948

[45] Dec. 7, 1982

[54] METHODS OF FILLING AND EMPTYING RADIATION SHIELDS

[76] Inventor: John A. Weissenfluh, 13212 Ridge Dr., Rockville, Md. 20850

[21] Appl. No.: 140,527

[22] Filed: Apr. 15, 1980

[51] Int. Cl.[3] ..... G21F 3/02

[52] U.S. Cl. ..... 250/519.1; 250/517.1

[58] Field of Search ..... 5/422, 451, 458, 449; 141/97, 10, 114; 250/518, 517, 519

[56] References Cited

U.S. PATENT DOCUMENTS

| | | | |
|---|---|---|---|
| 2,329,311 | 9/1943 | Waters | 141/10 |
| 2,401,950 | 6/1946 | McMahan | 141/10 |
| 2,815,621 | 12/1957 | Carter | 141/114 |
| 3,256,440 | 6/1966 | Stark | 250/518 |
| 3,973,603 | 8/1976 | Franz | 141/114 |

*Primary Examiner*—Harold A. Dixon

*Attorney, Agent, or Firm*—Baker & McKenzie

[57] ABSTRACT

Described are methods of filling and emptying radiation shields comprising a container formed of thin flexible material.

The method of filling comprises the steps of (a) filling the radiation shield with a gas to form the shield and then (b) replacing the gas with a radiation attenuating liquid.

Additionally, when the shield configuration is not entirely filled with radiation attenuating liquid, either deliberately or due to leakage, an overpressure of gas above the radiation attenuating liquid solidifies the shield in its designed dimensional configuration.

The method of emptying comprises the step of forcing the radiation attenuating liquid out through one or more outlets by forcing a gas into the radiation shield.

3 Claims, 2 Drawing Figures

METHODS OF FILLING AND EMPTYING RADIATION SHIELDS

TECHNICAL FIELD

This invention relates to radiation shields of the type comprising a container formed of thin flexible material filled with a radiation attenuating liquid.

BACKGROUND OF THE PRIOR ART

Radiation shields of the type comprising a container formed of thin flexible material filled with a radiation attenuating liquid were originally disclosed in my U.S. Pat. No. 4,090,087, issued May 16, 1978. Such radiation shields have come into widespread use. However, despite their popularity, their use has presented certain problems, particularly in properly filling and emptying the shields.

The radiation shields are stored in a collapsed condition, and, when it is desired to use one, it is taken out and filled with a radiation attenuating liquid, such as a hydrogeneous liquid. If the filling takes place remote from the radiation source, it is sometimes difficult to move the heavy and unwieldy filled shield into place adjacent to the radiation source. And, if the filling takes place adjacent to the radiation shield, the radiation shield sometimes unfolds and extends in unpredictable, exasperating, and potentially dangerous directions and orientations as the attenuating liquid is pumped into the shield, causing the shield to gradually take on its filled shape.

When it is desired to empty a radiation shield of this type, the common practice has been to open a liquid drain valve at the bottom and to allow the liquid to drain out. This practice has required lengthy waits, and the drainage is not always complete because there is only atmospheric pressure and/or mechanical manipulations of the bag to force the liquid out. Alternatively, in situations where the radiation shield is connected to a recycling system for the radiation attenuating liquid, such as is disclosed in my U.S. Pat. No. 4,090,087, the pump is either turned off or reversed, but the drainage is still quite slow.

OBJECTS OF THE INVENTION

It is, therefore, a general object of the invention to provide methods of filling and emptying such radiation shields which will obviate or minimize problems of the type previously described.

It is a particular object of the invention to provide a method of filling and forming such radiation shields which permits them to be easily and safely placed in a desired relationship to a radiation shield.

It is another object of the invention to provide a method of solidifying such shields in their developed dimensional configurations even when they are not entirely filled with radiation attenuating liquid, either deliberately or due to leakage.

It is still another object of the invention to provide a method of emptying such radiation shields which permits them to be rapidly and relatively completely emptied of radiation attenuating liquid.

Other objects and advantages of the invention will become apparent from the detailed description of a preferred embodiment thereof given hereinafter.

BRIEF SUMMARY OF THE INVENTION

The invention comprises (1) a method of filling radiation shields of the type previously described comprising the steps of (a) filling the radiation shield with a gas to form the shield and then (b) replacing the gas with a radiation attenuating liquid, (2) a method of solidifying such shields in their designed dimensional configurations when they are not entirely filled with radiation attenuating liquid, either deliberately or due to leakage, comprising the step of providing an overpressure of gas above the radiation attenuating liquid in the shields, and (3) a method of emptying such radiation shields comprising the step of forcing the radiation attenuating liquid out through one or more outlets by forcing a gas into the radiation shield.

DETAILED DESCRIPTION OF THE INVENTION

Figure 1:
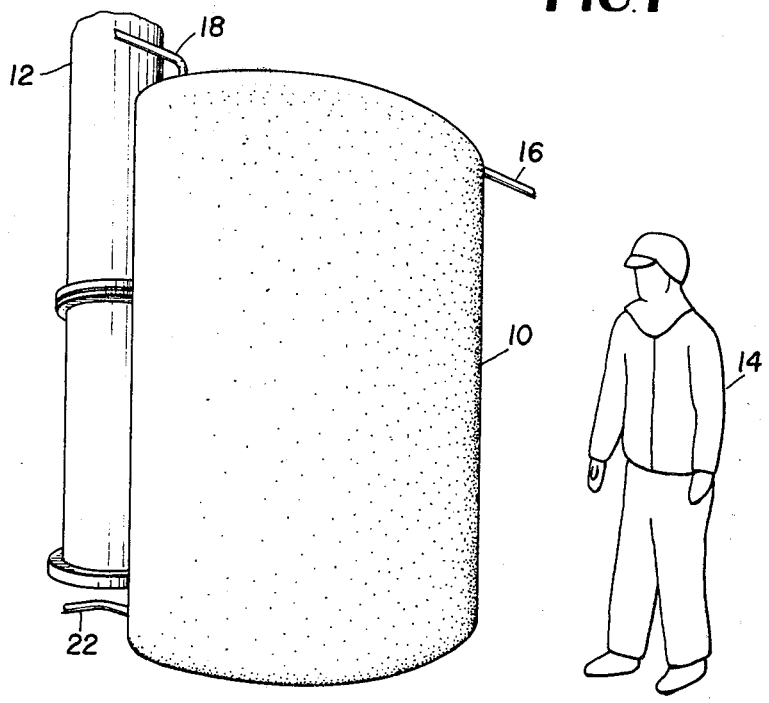
FIG. 1 is a perspective view of a radiation shield in place between a radiation source and a human being.

FIG. 1 shows a radiation shield 10 in place between a radiation source 12, depicted as a pipe containing a radioactive liquid, and a human being 14. Of course, the shape of the radiation shield 10 is merely illustrative. Several other shapes for such shields are shown in my U.S. Pat. No. 4,090,087, and many other shapes are usable and in fact in use. The subject invention is not limited in its utility to any particular shape of radiation shield.

Figure 2:
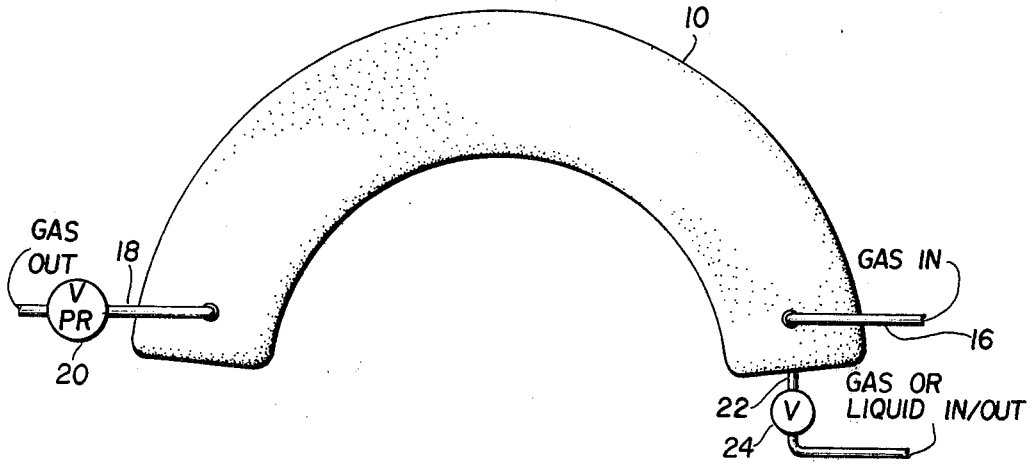
FIG. 2 is a plan view of a radiation shield adapted to use the subject invention.

FIG. 2 shows the radiation shield 10 in plan. It has a gas inlet 16, a gas outlet 18, a pressure relief valve 20, an inlet/outlet 22 for either gas or radiation attenuating liquid, and a valve 24 controlling the inlet/outlet 22.

In use, the inlet/outlet 22 is connected to a source of gas, such as an air pump, and the radiation shield 10 is inflated to form the radiation shield. During this step, the pressure relief valve 20 is set at a value (such as two pounds per square inch) which inflates the shield and which insures dimensional stability, but which does not permit an unnecessary amount of gas to be pumped into the shield. The radiation shield, which is then relatively light and easily manueverable, is then placed in a desired relationship to a radiation souce. After it has been properly positioned, the inlet/outlet 22 is connected to a container of radiation attenuating liquid (such as a hydrogeneous liquid which is denser than water), and the gas is replaced with the radiation attenuating liquid. As the radiation attenuating liquid is forced into the radiation shield, it displaces the gas.

The reason that the gas is preferably introduced through the inlet/outlet 22 rather than the gas inlet 16 during inflation of the radiation shield is that the weight of the line attached to the gas inlet 16 tends to pull the radiation shield over on its side when the radiation shield is only filled with gas. Of course, that is not a problem when the radiation shield is predominately filled with radiation attenuating liquid.

Radiation shields of this type occasionally leak during use, losing their dimensional stability. Accordingly, after the radiation shield is in place, it is desirable to connect the gas inlet 16 to a source of gas, such as an air pump, set to provide an overpressure of gas above the radiation attenuating liquid in the shield, thereby solidifying the shield in its designed dimensional configuration. The source is conveniently triggered by a sensor which detects when the overpressure has dropped beneath a set level (for instance, one pound per square inch) and thereupon causes the overpressure to be built back up to a desired sustaining level (for instance, two pounds per square inch).

When it is desired to deflate the radiation shield for storage or for transfer to another use, the gas inlet 16 is connected to a source of gas (if it is not already so connected), the valve 24 is opened, and gas is pumped into the radiation shield 10 through the gas inlet 16, forcing the radiation attenuating liquid out through the inlet/-outlet 22. If desired, the pressure relief valve 20 may be set at a higher than normal value (such as 2–3 p.s.i.) or closed entirely prior to this step. However, in practice the customary two pounds per square inch overpressure has been found adequate for this purpose.

After substantially all of the radiation attenuating liquid has been forced out of the radiation shield 10, the radiation shield 10 is once again light and manueverable and can be easily moved to another position. Or, if it is desired to deflate the shield for storage, the gas inlet 16 is disconnected from its source and the valve 24 and the pressure relief valve 20 are opened to atmosphere. The radiation shield 10 can then be collapsed like a giant balloon. If especially quick collapse is desired, it is even possible to connect one of more of the inlets to a vacuum pump.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

I claim:

1. A free-standing radiation shield for use in installations containing sources of radiation, said radiation shield comprising a container of generally uniform thickness formed of thin flexible material and means for filling said container with a radiation attenuating liquid, said radiation shield being many times taller than it is thick, being shaped such that said radiation shield is stable and free-standing, and being curved about an axis which is vertical when said radiation shield is in use.

2. A free-standing radiation shield as recited in claim 1 wherein said radiation shield is filled with a radiation attenuating liquid.

3. A method of emptying a radiation shield comprising a container formed of thin flexible material filled with a radiation attenuating liquid, said method comprising the steps of:

(a) first forcing the radiation attenuating liquid out through an outlet by forcing gas into the radiation shield and then (b) forcing the gas out of the radiation shield after substantially all of the radiation attenuating liquid has been forced out of the radiation shield, thereby deflating the radiation shield.

* * * * *